US007549952B2

(12) United States Patent
Towley, III et al.

(10) Patent No.: US 7,549,952 B2
(45) Date of Patent: Jun. 23, 2009

(54) SELECTORIZED DUMBBELL HAVING TWIN PIN SELECTOR

(75) Inventors: Carl K. Towley, III, Alexandria, MN (US); Gregory S. Olson, Owatonna, MN (US)

(73) Assignee: Intellex, Inc., Owatonna, MN (US)

( * ) Notice: Subject to any disclaimer, the term of this patent is extended or adjusted under 35 U.S.C. 154(b) by 0 days.

(21) Appl. No.: 11/888,338

(22) Filed: Jul. 31, 2007

(65) Prior Publication Data

US 2009/0036278 A1 Feb. 5, 2009

(51) Int. Cl.
*A63B 21/072* (2006.01)

(52) U.S. Cl. ..... 482/108; 482/106

(58) Field of Classification Search ..... 482/93, 482/106–109

See application file for complete search history.

(56) References Cited

U.S. PATENT DOCUMENTS

| | | | | |
|---|---|---|---|---|
| 4,529,198 | A | 7/1985 | Hettick, Jr. | |
| 5,637,064 | A | 6/1997 | Olson et al. | |
| 5,769,762 | A * | 6/1998 | Towley et al. | 482/93 |
| 5,971,899 | A | 10/1999 | Towley, III et al. | |
| 6,322,481 | B1 * | 11/2001 | Krull | 482/107 |
| 6,656,093 | B2 | 12/2003 | Chen | |
| 7,128,696 | B1 * | 10/2006 | Krull | 482/107 |
| 7,153,244 | B2 * | 12/2006 | Towley et al. | 482/108 |
| 7,172,536 | B2 * | 2/2007 | Liu | 482/108 |
| 2002/0002106 | A1 * | 1/2002 | Krull | 482/107 |
| 2003/0060344 | A1 * | 3/2003 | David | 482/98 |
| 2008/0032874 | A1 * | 2/2008 | Towley et al. | 482/106 |

* cited by examiner

*Primary Examiner*—Fenn C Mathew
(74) *Attorney, Agent, or Firm*—James W. Miller

(57) ABSTRACT

A selectorized dumbbell has a handle that can be inserted into a gap between stacks of nested left and right weight plates that are provided in a plurality of nested weights. A selector determines how many left weight plates are coupled to the left end of the handle and how many right weight plates are coupled to the right end of the handle. A single left weight plate and a single right weight plate are interconnected together by an interconnection member of some type to form a single weight. The interconnection members of the different weights overlie one another and are provided with two arrays of a plurality of unique sets of holes and slots. A first connecting pin is inserted through the handle and through a selected set of holes and slots in the first array. A second connecting pin is inserted through the handle and through a selected set of holes and slots in the second array. The two pins together symmetrically couple the desired number of weights to the handle in a balanced fashion.

9 Claims, 9 Drawing Sheets

SELECTORIZED DUMBBELL HAVING TWIN PIN SELECTOR

TECHNICAL FIELD

This invention relates to a selectorized dumbbell having a selector that the user manipulates to adjust the mass of the dumbbell by coupling desired numbers of weight plates to opposite ends of a handle.

BACKGROUND OF THE INVENTION

A full set of traditional dumbbells has various pairs of dumbbells with different mass, e.g. a pair of 5 pound dumbbells, a pair of 10 pound dumbbells, and so on. Such dumbbells are used for weight training exercises such as biceps curls, triceps extensions, etc. Different users will use whatever size dumbbells are most suited to their particular physical condition and exercise needs. For example, one user might lift 10 pound dumbbells while another user might lift 50 pound dumbbells.

Such a dumbbell set is both costly to purchase and requires a fair amount of storage space. Storage racks are needed simply to store the various pairs of dumbbells. As a practical matter, individuals and small gyms or exercise clubs may not be able to afford either the money or the storage space required for a full set of traditional dumbbells.

Selectorized dumbbells overcome the cost and space obstacles presented by traditional dumbbells. In a selectorized dumbbell, a plurality of weights are nested together. The weights provide a stack of nested left weight plates and a stack of nested right weight plates. The left and right stacks of weight plates are separated from one another by a gap.

In a selectorized dumbbell, a handle is inserted into the gap between the left and right stacks of weight plates. A selector is then manipulated to determine how many of the left and right weight plates of the weights are coupled to the left and right ends of the handle. Once the selector is positioned to pick up a selected number of weights, the handle can then be lifted by the user from between the stacks of weight plates. The selected number of weights will rise with the handle to be used in performing various exercises with the dumbbell.

The obvious advantages of selectorized dumbbells are the cost and space savings provided to the purchaser. Only two dumbbells need be purchased and not an entire set. Yet, these two dumbbells can provide a wide range of exercise mass depending upon how many of the nested weights are coupled to the handle by the selector. Moreover, the only storage space required is that needed for two dumbbells and the nested weights that accompany them. All of this can be stored on a small rack that takes up only a few square feet of floor space. Thus, a single pair of selectorized dumbbells provides an economical alternative to a full set of traditional dumbbells.

The Applicants' own U.S. Pat. No. 5,769,762 discloses a selectorized dumbbell in which the left and right weight plates in each stack thereof are coupled together in pairs by shallow, upwardly facing channels. Each weight thus comprises one left weight plate, one right weight plate and the interconnecting channel. The channel has vertically extending front and back walls. The channels of the different weights nest inside of another when the left and right weight plates are disposed in their nested stacks. When so nested, the front walls of the channels of all the weights overlie one another along a front side of the dumbbell and the back walls of the channels of all the weights similarly overlie one another along a back side of the dumbbell.

The overlying front walls of the channels are provided with various sets of aligned holes and slots. The different sets of aligned holes and slots are unique so that different numbers of weights will be coupled to the handle and picked up when a connecting pin is inserted through one set of holes and slots. This is how one adjusts the weight of the dumbbell. The pin is inserted into that set of holes and slots that will pick up the desired number of weights.

Identical sets of holes and slots are also arranged along the overlying back walls of the channels. The pin is long enough to extend between and span the distance between the front walls and the back walls of the channels. Thus, when the pin is inserted into a particular set of holes and slots in the front walls of the channels, the pin is long enough to extend through a corresponding set of holes and slots in the back walls of the channels.

The sets of holes and slots are necessarily distributed along the lengths of the front and back walls of the channels. One set of holes and slots may be arranged along a transverse centerline of the dumbbell, i.e. a line passing through the center of the dumbbell perpendicular to the front and back walls of the channels. But, the other sets of holes and slots will inherently be set to one side or the other of this transverse centerline, i.e. will be off center relative to the transverse centerline.

When the pin is inserted into any set of holes that is off center relative to the transverse centerline, the weights are coupled to the handle in an unbalanced configuration. The weight plates that are furthest from the pin will exert a torque about the pin that is greater than the torque exerted by the weight plates that are closest to the pin. This will cause the weight plates that are furthest from the pin to slightly droop or sag relative to the handle.

This is disadvantageous as it leaves the user with the impression that the weights are not securely attached to the handle even when they are. In addition, the dumbbell can feel somewhat unbalanced to the user when the user picks it up and exercises with it. This is particularly true when the pin is inserted through one of the outermost sets of holes and slots in which the pin is the furthest away from one set of the weight plates. In this pin orientation, the sense of unbalance is at its most pronounced.

In addition, the weights are coupled to the handle using only a single connecting pin with a single connecting prong. While the prong of the pin extends all the way through the dumbbell between the front and back walls of all the channels, there is always a possibility that the pin could become accidentally dislodged during use. In this case, the weights would detach from the handle.

Accordingly, there is a need in the art for a selectorized dumbbell in which the weights would be attached to the handle by a selector that couples the weights to the handle in a balanced manner from side to side. Desirably, such a selector would have a redundant safety mechanism for helping keep the weights securely attached to the handle even if a portion of the selector were inadvertently dislodged.

SUMMARY OF THE INVENTION

One aspect of this invention relates to an adjustable dumbbell which comprises a lifting handle having a hand grip. The handle has a transverse centerline substantially perpendicular to the hand grip. A plurality of individual weights have overlying portions. A plurality of sets of aligned holes and slots are placed in the overlying portions of the weights. Each set has a unique arrangement of holes and slots. Two duplicate arrays of the plurality of sets of aligned holes and slots are provided with one array being placed to the left of the transverse centerline and the other array being substantially symmetrically placed to the right of the transverse centerline. A connecting pin is selectively insertable through any one set of holes and slots in a particular array of holes and slots to select for use a particular weight or weights as determined by the hole and slot arrangement in the set through which the pin passes. Two individual connecting pins are provided with one pin passing through a selected set of holes and slots in one array and the other pin passing through a corresponding set of holes and slots in the other array, whereby the pair of pins connect the weights to the handle symmetrically relative to the transverse centerline.

Another aspect of this invention relates to a selectorized dumbbell which comprises a stack of nested left weight plates separated by a gap from a stack of nested right weight plates. A handle can be inserted into the gap between the weight plate stacks. The handle has a hand grip. A selector determines how many left weight plates are coupled to a left end of the handle and how many right weight plates are coupled to a right end of the handle. The selector comprises a pair of individual connecting pins that are separate from one another with the connecting pins being individually insertable into and through different portions of the handle in an insertion direction that is perpendicular to the hand grip to couple different numbers of left and right weight plates to the left and right ends of the handle.

Yet another aspect of this invention relates to a selectorized dumbbell which comprises a handle that can be inserted into a gap between stacks of nested left and right weight plates that are provided in a plurality of nested weights. A selector determines how many left weight plates are coupled to the left end of the handle and how many right weight plates are coupled to the right end of the handle. A single left weight plate and a single right weight plate are interconnected together by an interconnection member to form a single weight. The interconnection members of the different weights overlie one another and are provided with two duplicate arrays each having a plurality of unique sets of holes and slots. The selector comprises a first connecting pin inserted through the handle and through a selected set of holes and slots in one array thereof, and a second connecting pin that is separate and distinct from the first connecting pin with the second connecting pin being inserted through the handle and through a selected set of holes and slots in the other array thereof.

BRIEF DESCRIPTION OF THE DRAWINGS

This invention will be described more completely in the following Detailed Description, when taken in conjunction with the following drawings, in which like reference numerals refer to like elements throughout.

DETAILED DESCRIPTION

Figure 1:
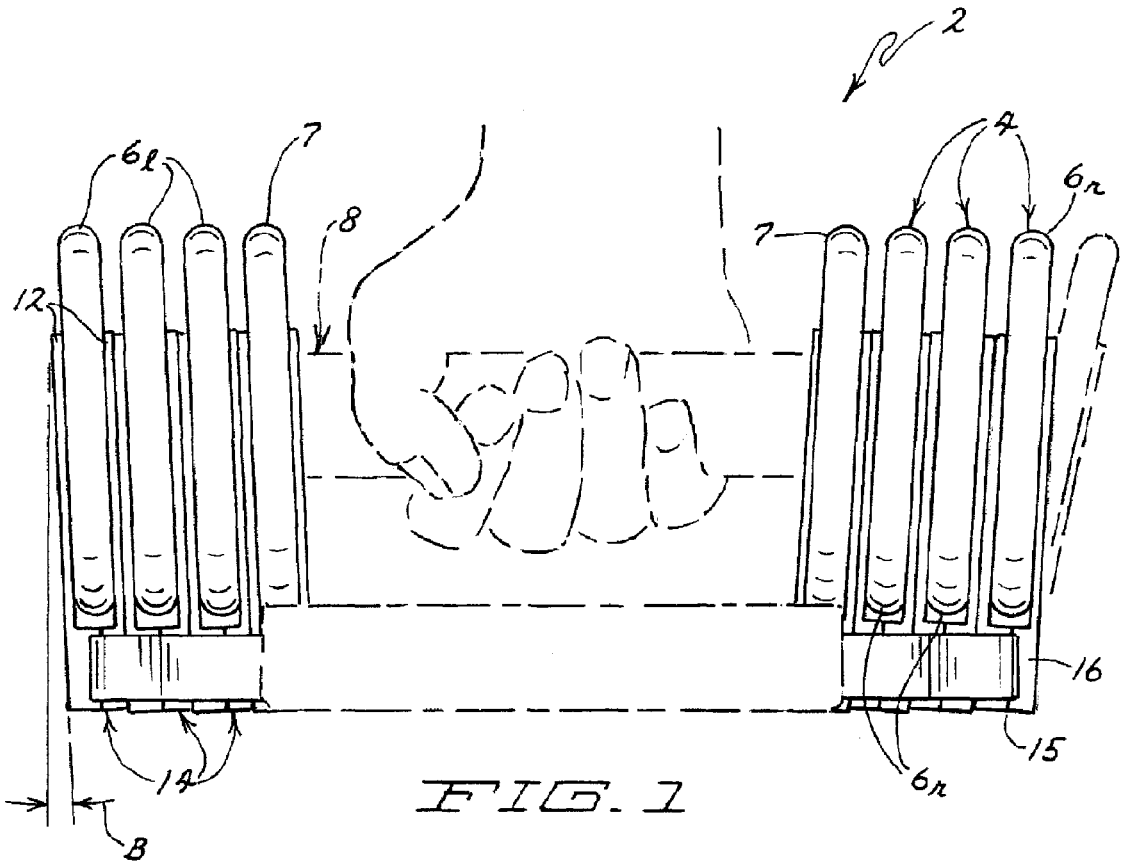
FIG. 1 is a front plan view of one embodiment of a selectorized dumbbell according to this invention with the selector and holes and slots having been omitted from this view in favor of their illustration in FIGS. 4-7.
Figure 2:
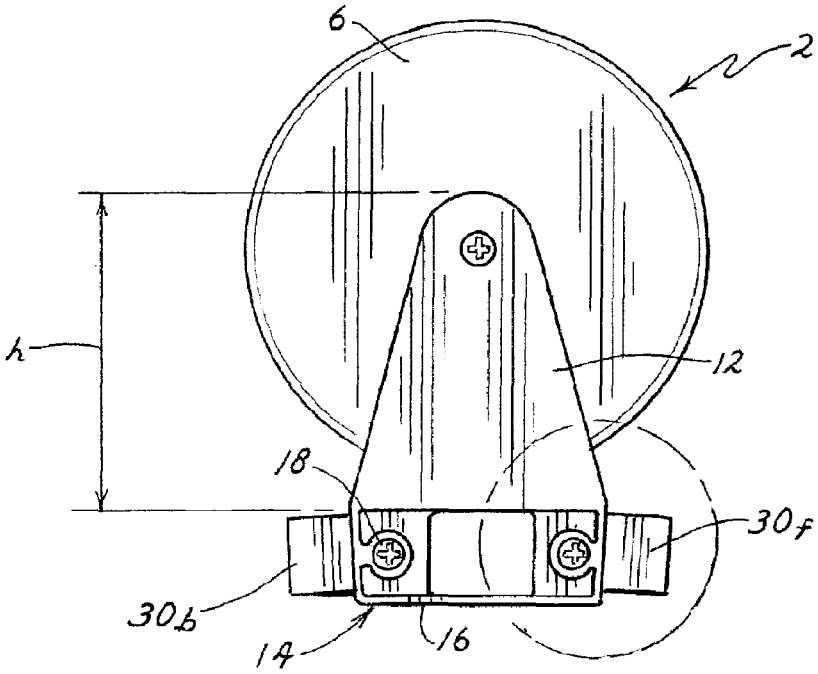
FIG. 2 is a side elevational view of the selectorized dumbbell of FIG. 1.

One embodiment of a selectorized dumbbell according to this invention is illustrated generally as 2 in FIG. 1. Dumbbell 2 is similar to that shown in the Applicants' U.S. Pat. Nos. 5,769,762 and 7,153,244, which are hereby incorporated by reference. Only those features of dumbbell 2 which relate to this invention will be described in detail herein. The materials incorporated by reference above can supply other information regarding the general structure and operation of dumbbell 2 in the event the reader hereof desires or requires such information.

Dumbbell 2 is illustrated in FIG. 1 having three nested weights 4. Weights 4 provide a stack of nested left weight plates $\mathbf{6}_l$ and a stack of nested right weight plates $\mathbf{6}_r$. The number of nested weights 4 can obviously vary. For example, dumbbell 2 shown in FIGS. 4-7 is configured to provide five nested weights rather than three. If desired, dumbbell handle 8 can also permanently carry a weight plate 7 at each end thereof as shown in FIG. 1. Alternatively, as shown in FIGS. 4-7, each end of handle 8 could simply comprise a side flange 9 that is free of any handle carried weight plates.

Handle 8 is inserted into a gap between the two stacks of nested left and right weight plates $\mathbf{6}_l$ and $\mathbf{6}_r$. The position of a selector 10 determines how many nested weights 4 are coupled to handle 8. This is how a user varies the exercise mass of a selectorized dumbbell 2, namely by adjusting selector 10. After a desired numbers of weights 4 are coupled to handle 8, the user can grip a hand grip 11 on handle 8 and lift upwardly on handle 8 to pick up the desired number of weights.

Figure 3:
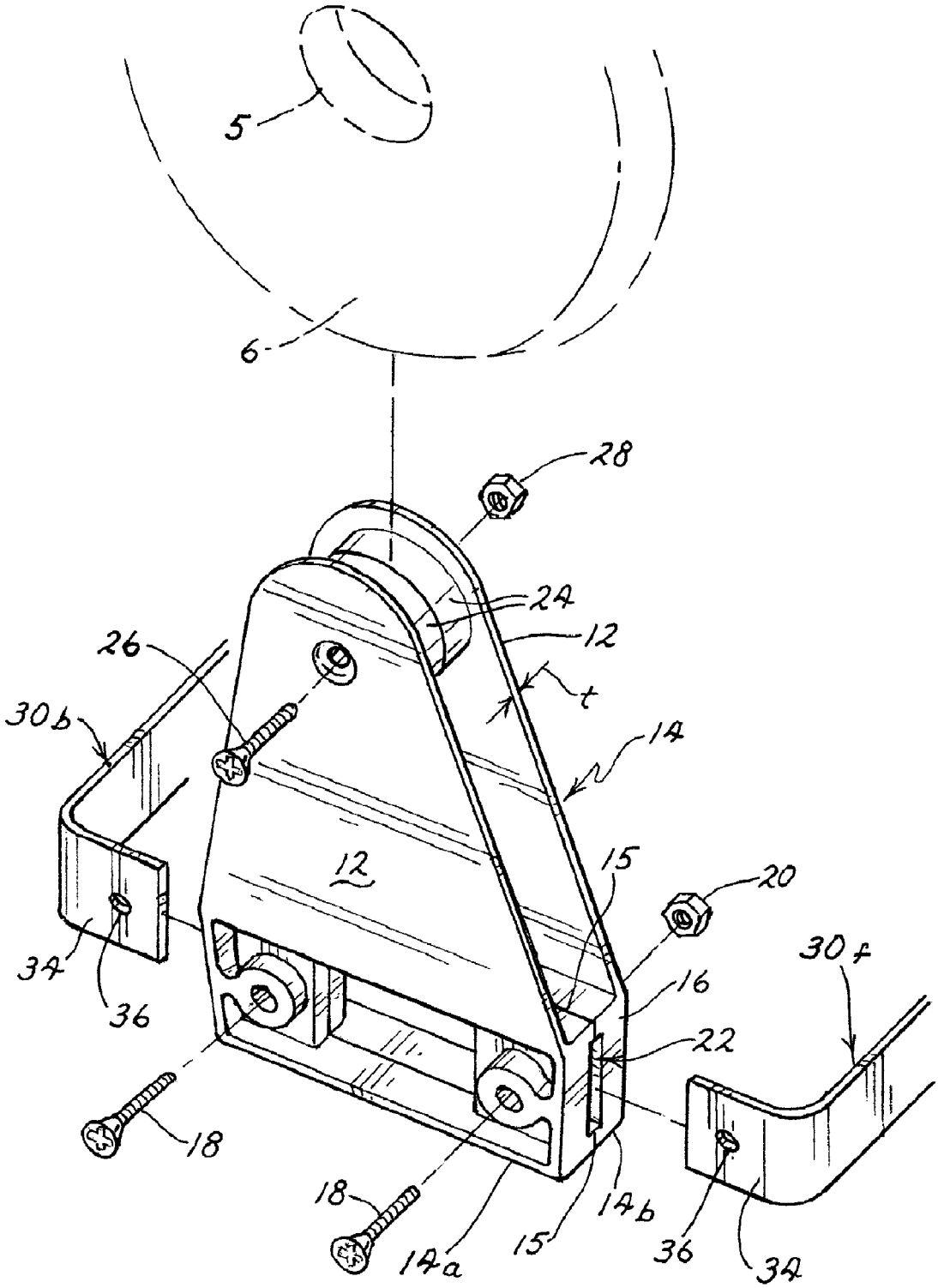
FIG. 3 is a perspective view of one end of one weight of the selectorized dumbbell of FIG. 1, particularly illustrating one of the weight plates of the weight along with the carrier that holds the weight plate to a pair of rails.

Each weight plate 6 in the various weights 4 is held between the arms 12 of a forked carrier 14. As shown in FIGS. 1 and 3, arms 12 extend upwardly from an underlying base 16 of carrier 14. Base 16 of carrier 14 is substantially rigid. Arms 12 taper inwardly as they rise from base 16 of carrier 14 to be generally triangular in shape. Arms 12 can be flexible if desired and are substantially smaller than weight plate 6 carried between arms 12.

Carriers 14 are made in two halves $\mathbf{14}_a$ and $\mathbf{14}_b$ as indicated in FIGS. 1 and 3 by the parting line 15 between halves $\mathbf{14}_a$, $\mathbf{14}_b$. Each carrier half $\mathbf{14}_a$ and $\mathbf{14}_b$ carries one of the flexible arms 12 in each pair of arms 12. Carrier halves $\mathbf{14}_a$, $\mathbf{14}_b$ are secured together by a plurality of attachment bolts 18 and nuts 20 shown in FIG. 3. When secured together, bolts 18 and nuts 20 are recessed within the left and right sides of base 16 of carrier 14 so that they do not project laterally outwardly beyond the left and right sides of base 16 of carrier 14. Carrier halves $\mathbf{14}_a$, $\mathbf{14}_b$ are also formed so as to provide a slot 22 in each of the front and back sides of base 16 of carrier 14 along parting line 15 between carrier halves $\mathbf{14}_a$, $\mathbf{14}_b$. Each carrier 14 extends perpendicularly relative to the axis of handle 8.

The upper ends of arms 12 of carrier 14 each have an inwardly protruding cylindrical stub shaft 24 for mounting weight plate 6 between arms 12. Stub shafts 24 on the pair of arms 12 protrude partly into a central mounting hole 5 provided in each weight plate 6 from either side of hole 5. Another attachment bolt 26 and nut 28 are provided to secure the upper ends of arms 12 together. When this occurs, stub shafts 24 abut one another to form, in effect, a cylindrical hub. This also holds weight plate 6 between arms 12 with hole 5 of weight plate 6 being concentrically received on the hub formed by stub shafts 24 on arms 12 of carrier 14. Again, the head of attachment bolt 26 and nut 28 are seated in recesses in arms 12 so that the attachment bolt and nut do not protrude beyond the outer faces of arms 12.

Each nested weight 4 preferably comprises a pair of carriers 14 and a pair of weight plates 6, namely a first carrier 14 carrying left weight plate $\mathbf{6}_l$ and a second carrier 14 carrying right weight plate $\mathbf{6}_r$. Weight plates 6 comprising each weight 4 are laterally spaced apart from one another. A pair of interconnecting members comprising a front rail $\mathbf{30}_f$ and a back rail $\mathbf{30}_b$ unite or join the laterally spaced apart weight plates 6 together. The front and back rails 30 used in different weights 4 have progressively increasing lengths as one proceeds from the inner to the outer weights 4 in each stack. This progressively increases the spacing between the left and right weight plates $\mathbf{6}_l$ and $\mathbf{6}_r$ in each weight 4 to allow the different weights 4 to be nested together. Rails 30 comprise strap like steel rails having a substantially flat cross-sectional profile.

Opposite ends of rails 30 are easily bent into an L-shape to provide inturned ends 34. Ends 34 are received in slots 22 formed along the parting lines 15 between carrier halves $\mathbf{14}_a$, $\mathbf{14}_b$. Each inturned end 34 includes an opening 36 for allowing one of the attachment bolts 28 that secure carrier halves $\mathbf{14}_a$, $\mathbf{14}_b$ together to pass through the end 34 of rail 30. Like the lengths of rails 30, inturned ends 34 of rails 30 progressively increase in depth from rails 30 used on the inner to the outer weights 6 in each stack. This allows rails 30 of the different weights 4 to nest inside one another as shown in FIGS. 4-8.

Figure 4:
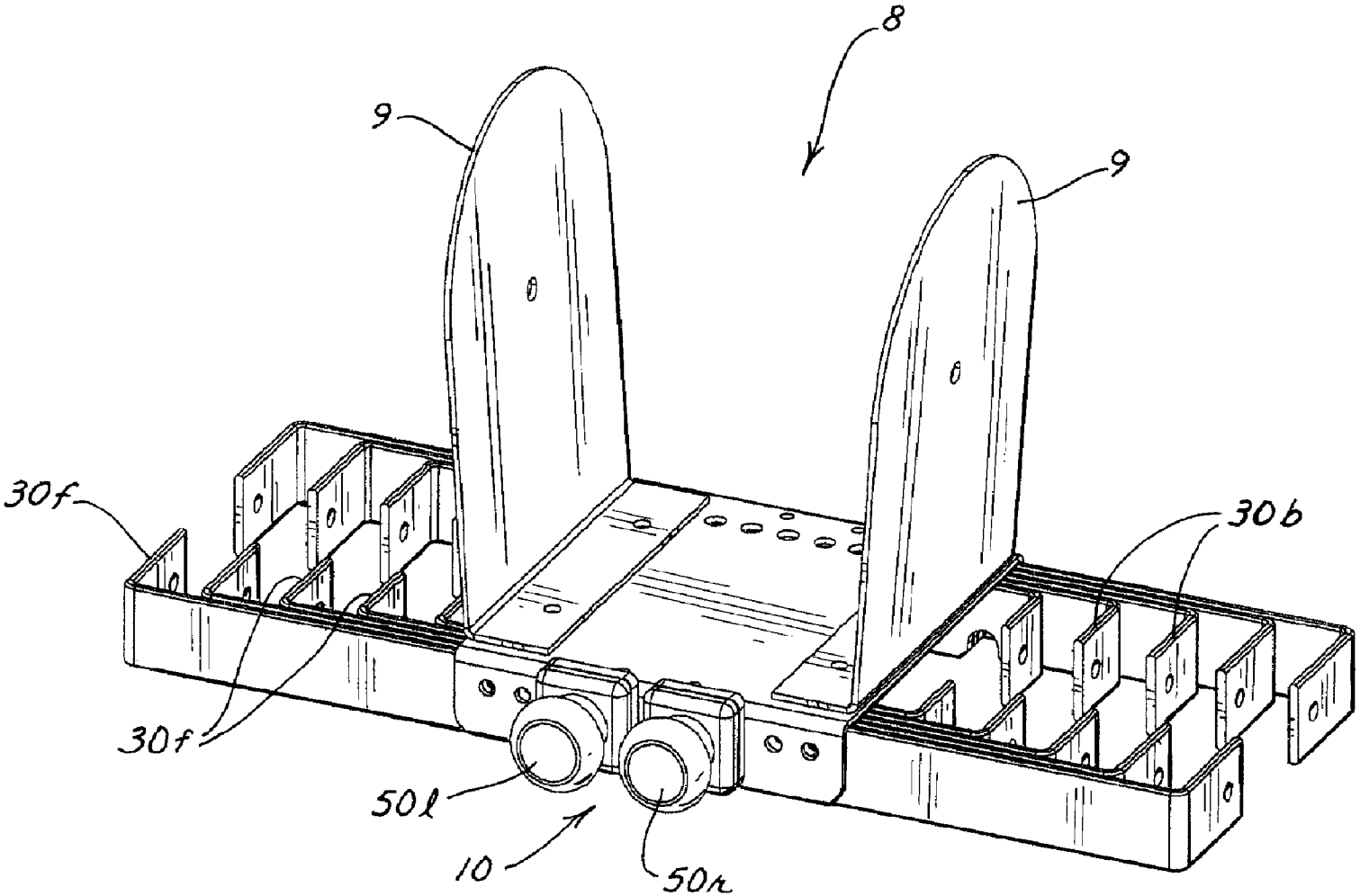
FIG. 4 is a perspective view of a portion of the selectorized dumbbell of FIG. 1, particularly illustrating the twin pin selector for coupling a desired number of weights to the handle.
Figure 5:
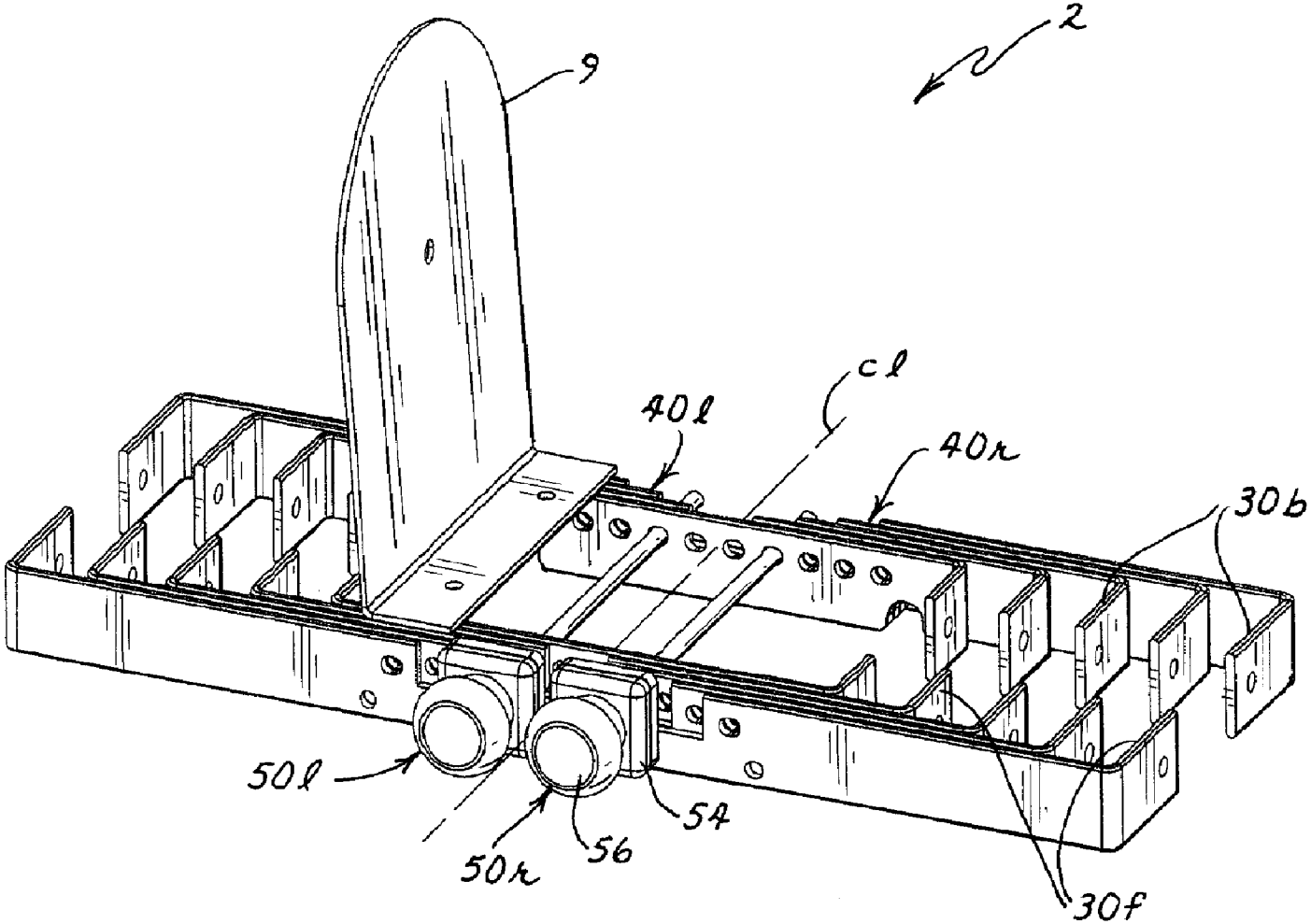
FIG. 5 is a perspective view similar to FIG. 4, but having a portion of the handle removed to better illustrate the twin pin selector and its interaction with the sets of holes and slots in the front and back rails.
Figure 6:
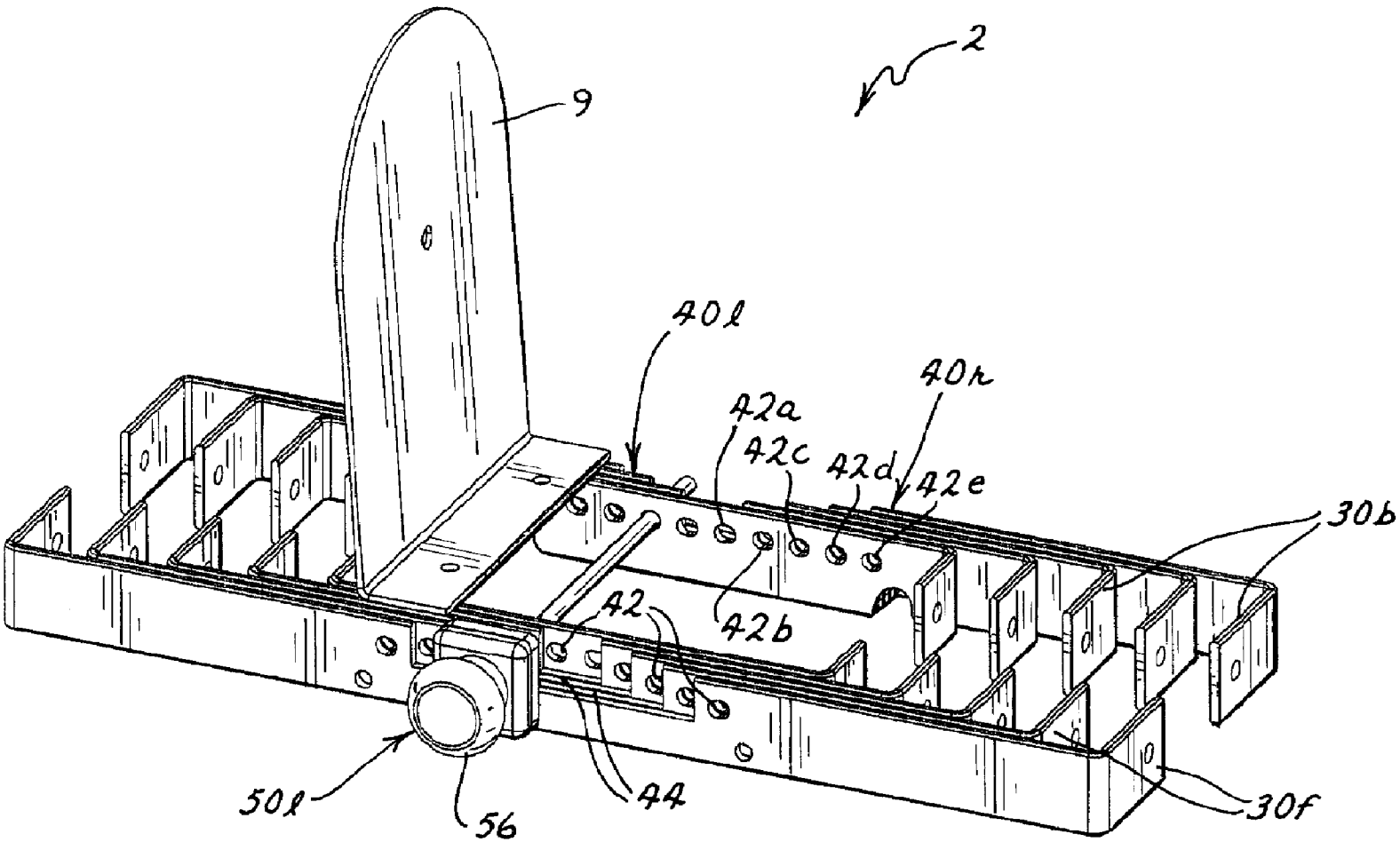
FIG. 6 is a perspective view similar to FIGS. 4 and 5, but having one of the twin pins removed to better illustrate the sets of holes and slots in the front and back rails.

Referring now to FIGS. 4-8, rails 30 are provided with duplicate left and right arrays $\mathbf{40}_l$ and $\mathbf{40}_r$ of various sets a-e of holes 42 and slots 44. A transverse centerline of dumbbell 2 is indicated as $c_l$ in FIG. 5. The left hole and slot array $\mathbf{40}_l$ is so named and labeled as it is spread out along the length of rails 30 to the left of transverse centerline $c_l$. Similarly, as can be seen in FIG. 5, the right hole and slot array $\mathbf{40}_r$ is spread out along the length of rails 30 to the right of transverse centerline $c_l$. Transverse centerline $c_l$ is itself perpendicular to the hand grip 11 of handle 8 and to the direction of elongation of rails 30.

Each hole and slot array 40, whether it be the left array $\mathbf{40}_l$ or the right array $\mathbf{40}_r$, is identical and comprises various unique sets a-e of holes 42 and slots 44. Each set a-e of holes 42 and slots 44 extends parallel to transverse centerline $c_l$. The number of sets a-e of holes 42 and slots 44 in each array 40 corresponds to the number of weights 4. Since dumbbell 2 of FIGS. 4-8 is shown configured to support five weights 4, each array 40 has five sets of holes 42 and slots 44, namely set a, set b, set c, set d and set e.

Looking at the different sets a-e of holes 42 and slots 44 in each array 40, set a is the innermost set of holes 42 and slots 44, set b is located immediately outside of set a, set c is located immediately outside of set b, and so on to the last set, set e, which is the outermost set of holes 42 and slots 44 in the array 40. The sets a-e of holes 42 and slots 44 are unique in the following manner:

set a has one hole 42*a* and four slots 44*a* transversely aligned therewith;

set b has two holes 42*b* and three slots 44*b* transversely aligned therewith;

set c has three holes 42*c* and two slots 44*c* transversely aligned therewith;

set d has four holes 42*d* and one slot 44*d* transversely aligned therewith; and set e has five transversely aligned holes 42*e* and no slots.

Figure 7:
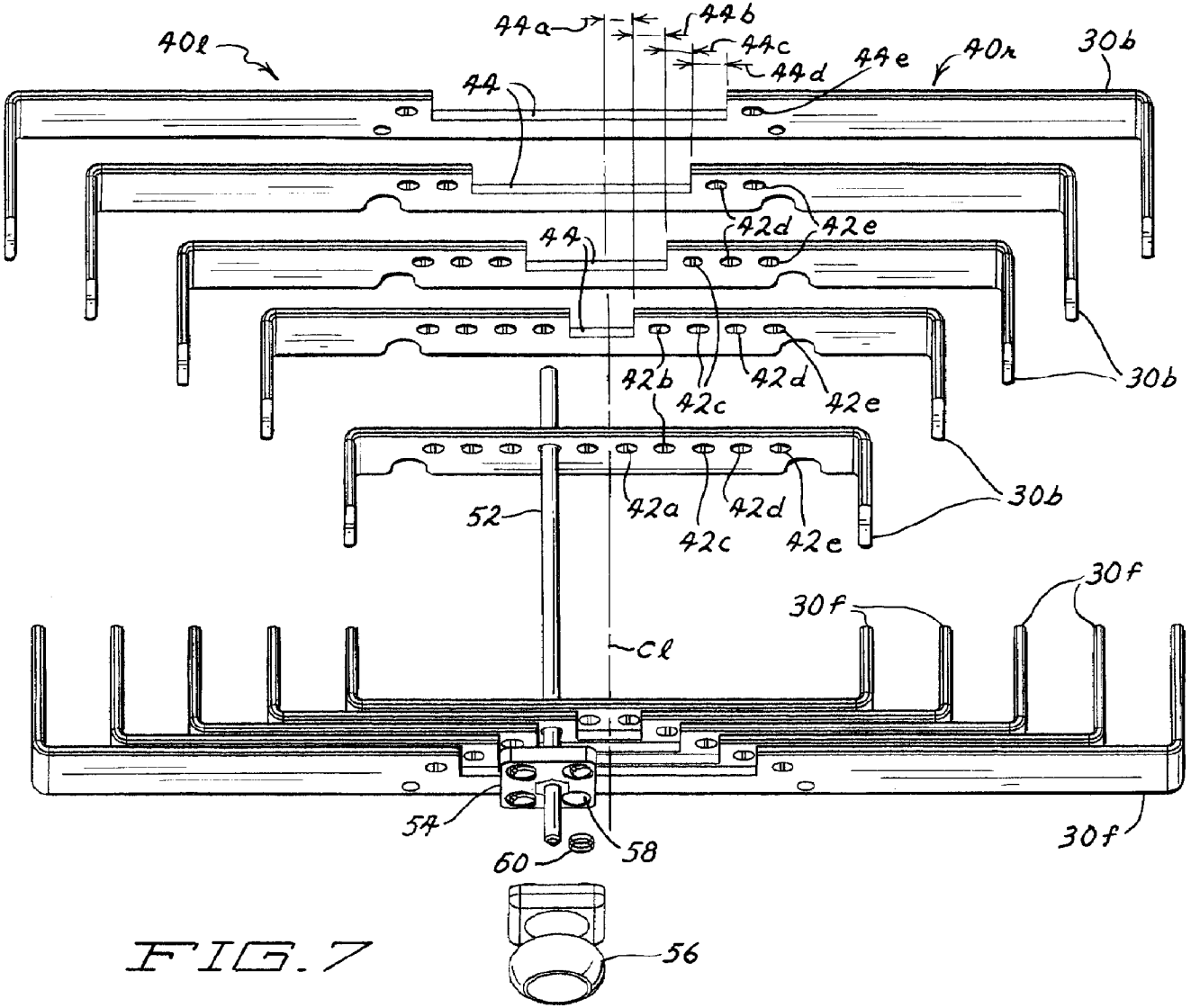
FIG. 7 is a perspective view similar to FIGS. 4-6, but having the back rails and one of the pins shown in an exploded form.

FIG. 7 shows how rails 30 are bored and slotted to provide the different sets of aligned holes 42 and slots 44. The slotted portions of rails 30 have different lengths rather than being individual slots 44 so that the longer slotted portions in rails 30 effectively provide multiple slots 44 in the different sets a-d. In this case, adjoining sections of the long slotted portions of rail 30 provide different slots 44 in the different sets a-d. For example, looking at FIG. 6, note how the very long slotted portion in the first or outermost rail $\mathbf{30}_f$ or $\mathbf{30}_b$ effectively overlies all of the holes 42 in the remaining four inner rails $\mathbf{30}_f$ or $\mathbf{30}_b$. Thus, the long slotted portion in the first or outermost rail $\mathbf{30}_f$ or $\mathbf{30}_b$ effectively forms four slots 44*a*, 44*b*, 44*c*, and 44*d* for the four sets a-d, respectively. See FIG. 7. As noted earlier, the outermost rail 30 could have had four individual slots 44*a*, 44*b*, 44*c* and 44*d* cut into it to do the same thing, but simply using adjacent portions of one long slot 44 is also effective.

Selector 10 comprises a pair of individual connecting pins 50. A left connecting pin 50*l* is provided for the left array $\mathbf{40}_l$ of holes 42 and slots 44. A right connecting pin 50*r* is provided for the right array $\mathbf{40}_r$ of holes 42 and slots 44. Left and right connecting pins 50*l* and 50*r* are identical to one another.

As shown in FIG. 4, handle 8 has a U-shaped base 70 with downwardly extending front and back walls $\mathbf{72}_f$ and $\mathbf{72}_b$. Each wall 72 has a series of spaced holes 74 that correspond to the number of sets a-e of holes 42 and slots 44 in the two arrays $\mathbf{40}_l$ and $\mathbf{40}_r$. Since each array 40 has five sets a-e, each wall 72 will have ten holes 74. Each hole 74 in each wall 72 aligns with one set a, b, c, d, or e of holes 42 and slots 44 in one of the arrays $\mathbf{40}_l$ or $\mathbf{40}_r$.

Each connecting pin 50 has an elongated connecting prong 52 that is long enough to extend transversely through dumbbell 2 and span between and through front rails $\mathbf{30}_f$ and back rails $\mathbf{30}_b$ and between and through front and back walls $\mathbf{72}_f$ and $\mathbf{72}_b$ of handle base 70. Connecting prong 52 is rigidly connected to a base 54 that is itself rigidly connected to an enlarged outer knob or head 56. Base 54 carries a plurality of recesses 58 in which magnets 60 are received. Thus, when connecting pin 50 is inserted into one of the sets a-e of holes 42 and slots 44 in rails 30 and into the corresponding hole 74 on handle base 70, as shown in FIGS. 4-8, base 54 of connecting pin 50 is magnetically attracted to the front wall $\mathbf{72}_f$ of handle base 70 to help hold pin 50 in place. See FIG. 4.

Figure 8:
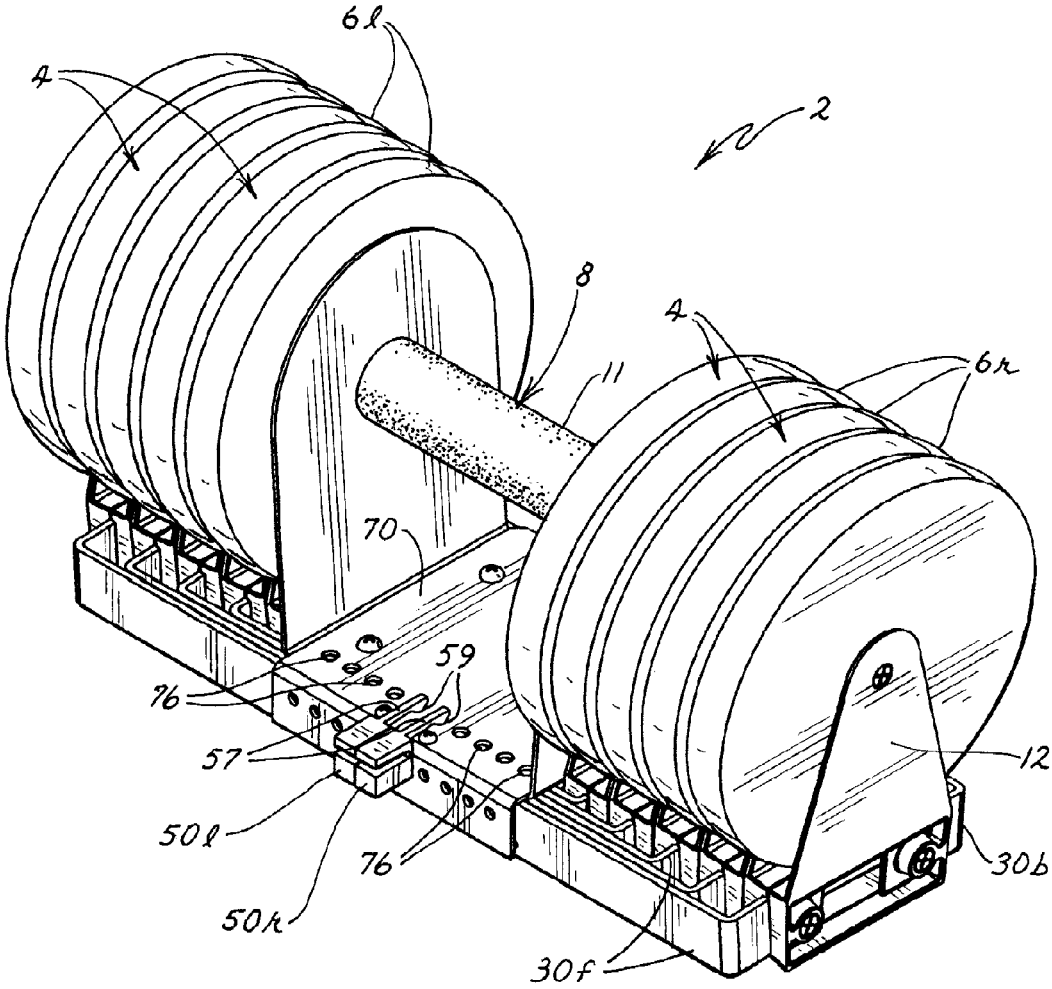
FIG. 8 is a perspective view of a dumbbell according to this invention, particularly illustrating an alternative embodiment for the pins comprising the selector.

FIG. 8 discloses an alternative form of connecting pin 50. In this pin 50, the enlarged head 56 includes a resilient detent finger 57 having a downwardly extending hook or tab 59 on the front end thereof. Base 70 of handle 8 has a series of upwardly facing detent holes 76 that correspond in number and placement to the connecting holes 74 in the front and back walls $\mathbf{72}_f$ and $\mathbf{72}_b$ of base 70. When pin 50 as shown in FIG. 8 is pushed into one of the sets a-e of holes 42 and slots 44 in each array $\mathbf{40}_l$ and $\mathbf{40}_r$ thereof, tab 59 of detent finger 57 will snap down into one of the detent holes 76 in base 70 of handle 8 to help hold pin 50 in place. Thus, this form of pin 50 uses a mechanical detent rather than a magnetic attraction to help retain pin 50 in place.

It should be apparent that the weight of dumbbell 2 is adjusted by selecting which set of holes 42 and slots 44 is used to receive pin 50. If pin 50 is inserted into set a, then only one weight 4 will be coupled to handle 8, namely the innermost nested weight 4. That is so because pin 50 only passes through one hole 42*a*, namely the hole 42*a* in the rails $\mathbf{30}_f$ and $\mathbf{30}_b$ for weight 4, and otherwise passes through the slots 44*a* in the rails 30 for all the other weights. In this position, when handle 8 is lifted, only the innermost nested weight 4 comes with it.

If the user wants to increase the amount of weight coupled to handle 8, the user need only adjust pin 50 to be inserted through one of the other sets b-e of holes 42 and slots 44. If set b is used, two weights 4 get picked up. If set c is used, three weights 4 get picked up, and so on until all five weights get picked up when set e is used. Thus, the exercise mass provided by dumbbell 2 can be easily adjusted simply by inserting connecting pin 50 into one of the sets a-e of holes 42 and slots 44.

Dumbbell 2 has duplicate left and right arrays $\mathbf{40}_l$ and $\mathbf{40}_r$ of sets a-e on holes 42 and slots 44 arranged in both front rails $\mathbf{30}_f$ and back rails $\mathbf{30}_b$. Selector 10 comprises two left and right connecting pins $\mathbf{50}_l$ and $\mathbf{50}_r$, one for each array $\mathbf{40}_l$ and $\mathbf{40}_r$. Thus, the weights 4 get pinned to handle 8 at symmetrical locations relative to the centerline $c_l$ so that the pinning is not unbalanced to one side or the other of centerline $c_l$. This is an advantage since it provides a more secure engagement and prevents dumbbell 2 from ever feeling unbalanced to the user.

In addition, as the weight carried by handle 8 increases, pins 50 get progressively further spread out along rails 30 to increase the distance between pins 50. This also helps provide a stable and secure feeling of engagement as the amount of weight carried by handle 8 increases. However, the inverse could be alternatively used if desired, i.e. pins 50 could get closer together as the number of weights 4 coupled to handle 8 increases.

Another advantage of the twin pins 50 disclosed herein is an added layer of safety. Even if one pin 50 is accidentally dislodged, the other remaining pin 50 will be strong enough to keep weights 4 coupled to handle 8.

Figure 9:
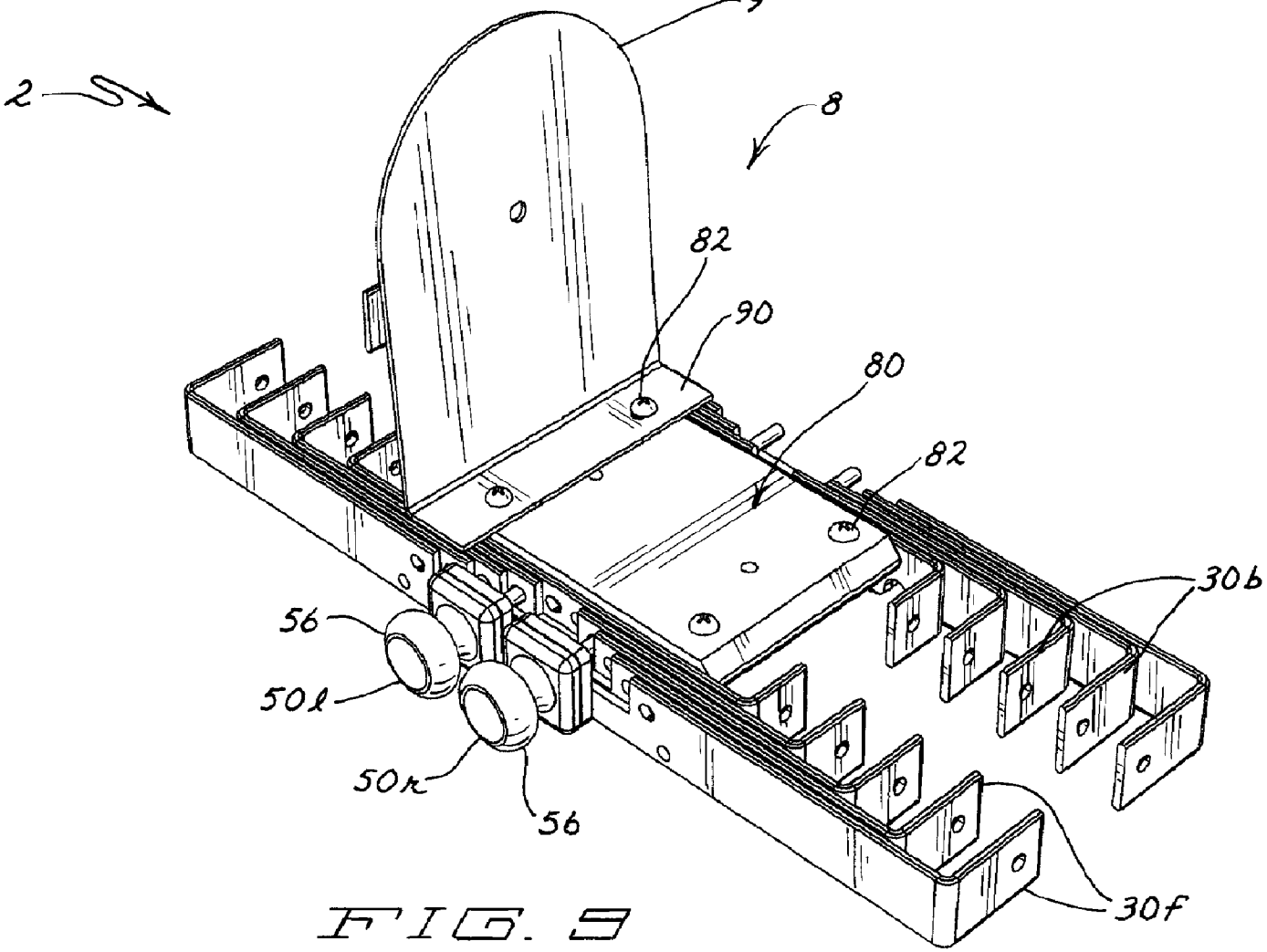
FIG. 9 is a perspective view of a dumbbell according to this invention, particularly illustrating a guide block that may be used in the dumbbell to help a user insert the connecting pins.
Figure 10:
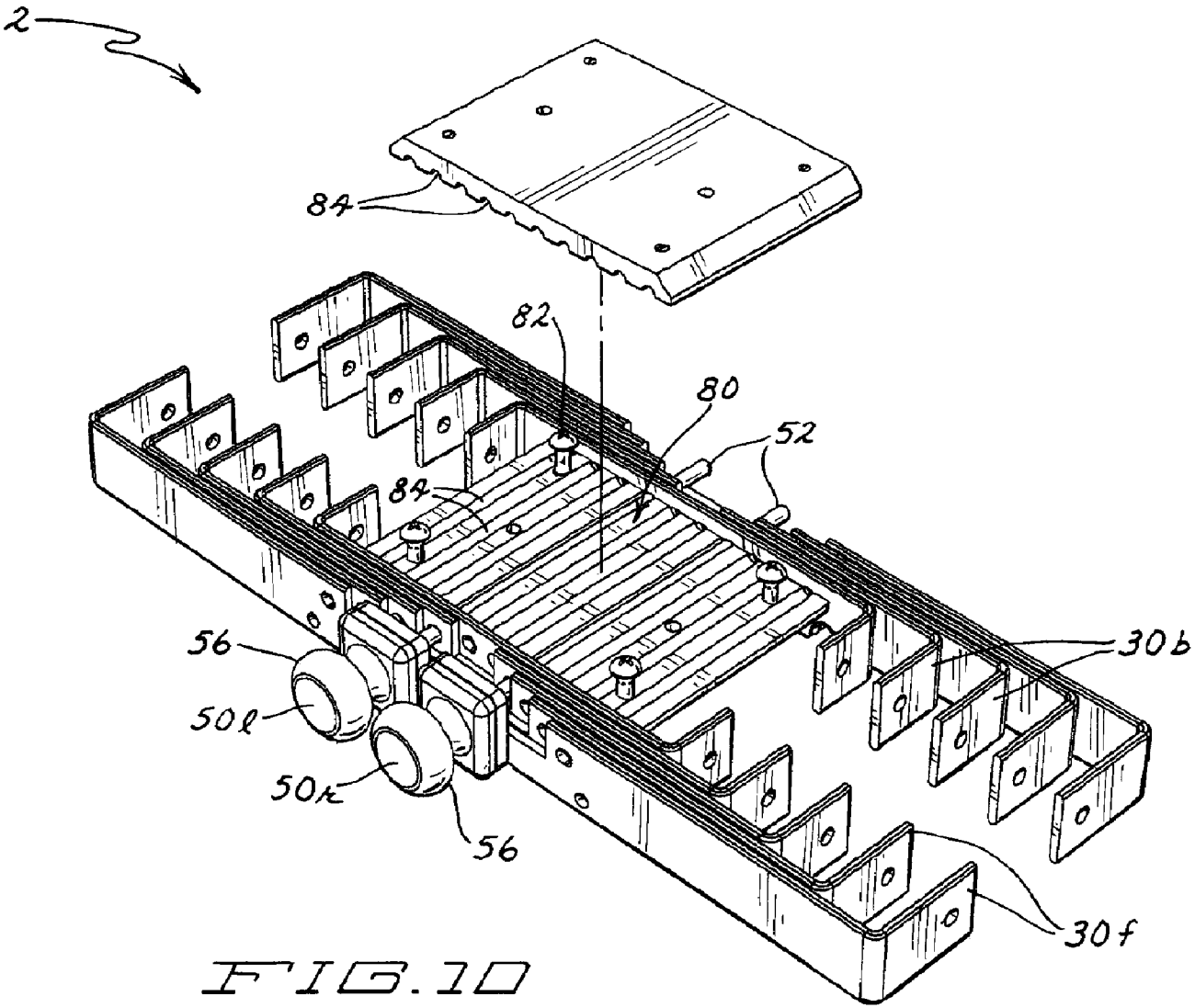
FIG. 10 is a perspective similar to FIG. 9, particularly illustrating the top of the guide block in an exploded form to illustrate the interior of the guide block.

Referring now to FIGS. 9 and 10, a guide block 80 could be attached to the underside of base 70 of handle 8 by a plurality of bolts 82. Guide block 80 has a plurality of transverse channels 84 extending therethrough between the front and back sides of guide block 80. Each channel 84 is aligned with one of the sets a-e of holes 42 and slots 44 in each array 40 thereof. Channels 84 help the user properly insert connecting pins 50 into a desired set a, b, c, d or e of holes 42 and slots 44 with channels 84 helping guide connecting prongs 52 across the distance between front rails $\mathbf{30}_f$ and back rails $\mathbf{30}_b$. Thus, the user need not hunt and peck for the correct set of holes on the back rails $\mathbf{30}_b$ but will be guided thereto by guide channels 84 in guide block 80. However, guide block 80 could be dispensed with if so desired.

Various other modifications of this invention will be apparent to those skilled in the art. Thus, the scope of this invention is to be limited only by the appended claims.

We claim:

1. An adjustable dumbbell, which comprises:

(a) a lifting handle having a hand grip, wherein the handle has a transverse centerline substantially perpendicular to the hand grip;

(b) a plurality of individual weights having overlying portions, wherein the overlying portions of the weights are provided in two groups with a first group of overlying portions being on a front side of the dumbbell and a second group of overlying portions being on a rear side of the dumbbell;

(c) a plurality of sets of aligned holes and slots placed in the overlying portions of the weights, wherein each set has a unique arrangement of holes and slots, wherein two duplicate arrays of the plurality of sets of aligned holes and slots are provided with one array being placed to the left of the transverse centerline and the other array being substantially symmetrically placed to the right of the transverse centerline, and wherein the duplicate arrays are provided on both the first and second groups of overlying portions; and (d) a connecting pin selectively insertable through any one set of holes and slots in a particular array of holes and slots to select for use a particular weight or weights as determined by the hole and slot arrangement in the set through which the pin passes, wherein two individual connecting pins are provided with one pin passing through a selected set of holes and slots in one array and the other pin passing through a corresponding set of holes and slots in the other array, whereby the pair of pins connect the weights to the handle symmetrically relative to the transverse centerline, and wherein each of the connecting pins is long enough to extend between the front and rear sides of the dumbbell such that each pin is simultaneously received in the selected set of holes and slots in both the first and second groups of overlying portions.

2. The dumbbell of claim 1, wherein the connecting pins progressively connect at distances that are progressively further away from the transverse centerline as the number of weights coupled to the handle increases.

3. The dumbbell of claim 1, further including a guide member attached to the handle for guiding the connecting pins between the first and second groups of overlying portions such that the guide pins are directed to the same set of holes and slots in the second group of overlying portions as the user selected in the first group of overlying portions.

4. The dumbbell of claim 3, wherein the guide member is a guide block attached to an underside of a base of the handle.

5. The dumbbell of claim 4, wherein the guide block has a plurality of guide channels, wherein each guide channel is aligned with one set of holes and slots in the first group of overlying portions and a corresponding set of holes and slots in the second group of overlying portions.

6. The dumbbell of claim 1, wherein the pin has at least one retention member thereon for releasably coupling the pin to the handle.

7. The dumbbell of claim 6, wherein the at least one retention member is at least one magnet for magnetically attracting the pin to a portion of the handle.

8. The dumbbell of claim 6, wherein the at least one retention member is at least one flexible detent finger for being received in one of a plurality of detent holes on the handle.

9. A selectorized dumbbell, which comprises:

(a) a stack of nested left weight plates separated by a gap from a stack of nested right weight plates, (b) a handle that can be inserted into the gap between the weight plate stacks, the handle having a hand grip;

(c) a selector that determines how many left weight plates are coupled to a left end of the handle and how many right weight plates are coupled to a right end of the handle, wherein the selector comprises only a single pair of individual connecting pins that are separate from one another with the connecting pins being individually insertable into and through different portions of the handle in an insertion direction that is horizontal and perpendicular to the hand grip to couple different numbers of left and right weight plates to the left and right ends of the handle, wherein the pair of connecting pins comprise the only connecting pins used to couple the left and right weight plates to the handle regardless of the number of left and right weight plates coupled to the handle; and (d) wherein the connecting pins are arranged to be symmetrically inserted through different portions of the handle on either side of a transverse centerline of the handle and of the dumbbell and when so symmetrically inserted each connecting pin will couple the same number of left weight plates to the left end of the handle as the number of right weight plates to the right end of the handle, and wherein the connecting pins when so symmetrically inserted are both located between the left weight plates carried on the left end of the handle and the right weight plates carried on the right end of the handle.

* * * * *